US005713377A

United States Patent [19]

Gerding et al.

[11] Patent Number: 5,713,377

[45] Date of Patent: Feb. 3, 1998

[54] TOBACCO CARTRIDGE

[75] Inventors: Guillermo Gerding, Hamburg; Dirk Pangritz, Wedel; Werner Schneider, Quickborn, all of Germany

[73] Assignee: British-American Tobacco (Germany) GmbH, Hamburg, Germany

[21] Appl. No.: 503,057

[22] Filed: Jul. 17, 1995

[30] Foreign Application Priority Data

Jul. 19, 1994 [DE] Germany ..... 44 25 538.1

[51] Int. Cl.[6] ..... A24D 1/00

[52] U.S. Cl. ..... 131/364; 131/70; 131/336; 131/341; 131/342

[58] Field of Search ..... 131/360, 361, 131/364, 331, 336, 341, 342, 70

[56] References Cited

U.S. PATENT DOCUMENTS

| | | | |
|---|---|---|---|
| 2,747,579 | 5/1956 | Gage et al. | 131/361 |
| 2,911,979 | 11/1959 | Bramhill | 131/361 |
| 3,251,365 | 5/1966 | Keith, II et al. | 131/342 X |
| 3,658,069 | 4/1972 | Wise et al. | 131/342 |
| 4,038,992 | 8/1977 | Ogasa et al. | 131/342 |
| 4,174,720 | 11/1979 | Hall | 131/342 X |
| 4,433,696 | 2/1984 | Adams | 131/336 |
| 4,564,030 | 1/1986 | Jessup et al. | 131/361 X |
| 4,649,944 | 3/1987 | Houck, Jr. et al. | 131/336 |
| 4,874,004 | 10/1989 | Borowski et al. | 131/361 X |
| 4,887,617 | 12/1989 | Ruppert et al. | 131/70 |
| 4,904,308 | 2/1990 | Charlton et al. | 131/336 X |
| 4,924,883 | 5/1990 | Perfetti et al. | 131/336 |
| 5,141,000 | 8/1992 | Ruppert et al. | 131/360 X |
| 5,167,241 | 12/1992 | Ruppert et al. | 131/70 |

FOREIGN PATENT DOCUMENTS

| | | |
|---|---|---|
| 34 07 461 C1 | 10/1985 | Germany . |
| 37 43 597 C1 | 2/1989 | Germany . |
| 39 01 226 C1 | 7/1990 | Germany . |
| 41 07 522 A1 | 9/1992 | Germany . |
| 43 21 069 A1 | 1/1995 | Germany . |

*Primary Examiner*—Jennifer Bahr
*Attorney, Agent, or Firm*—Armstrong, Westerman, Hattori, McLeland, & Naughton

[57] ABSTRACT

The invention relates to a coaxial tobacco cartridge with an inner core of a first tobacco blend, a sheath for the inner core, an outer jacket of a second tobacco blend, a sheath of high air permeability and an associated filter element. The coaxial tobacco cartridge is not smokable independently, but can be used by persons to make their own coaxial cigarettes, by inserting it in an appropriate cigarette-paper tube or wrapping it in a cigarette-paper strip.

20 Claims, 1 Drawing Sheet

TOBACCO CARTRIDGE

BACKGROUND OF THE INVENTION

The invention relates to a tobacco cartridge according to the preamble of claim 1 as well as to use thereof by consumers for making their own cigarettes.

German Patent DE 3,407,461 C1 teaches a tobacco product consisting of a pre-apportioned tobacco supply for smoking, surrounded tubularly by cigarette paper. The tobacco supply has the form of a dimensionally stable strand of tobacco that is adapted to the tobacco filling of the finished cigarette and as such is not smokable, although it consists completely of smokable material. It can be inserted in a pre-made cigarette-paper tube, allowing consumers to make their own unfiltered or filter cigarettes. The tobacco cartridges used consist in this case of a homogeneous tobacco core and a sheath that ensures dimensional stability. Because of the high air permeability of the sheath, the tobacco cartridge cannot be smoked as such.

A similar system is known from German Patent DE 4,107,026 C1, wherein the sheath of the tobacco cartridge exhibits zones of extreme porosity of between 25,000 and 40,000 in $cm^3min^{-1}cm^{-2}$ at 1 kPA, measured in Coresta units per DIN ISO 2965. The remaining part of the sheath as well as parts of the cigarette paper of the tube covering the sheath must be of low porosity. By shifting the tobacco cartridge and cigarette tube relative to each other, consumers are supposed to be able to adjust the quantity of air mixed with the smoke to suit their own preferences.

The problems addressed in the area of tobacco cartridges have related either to introduction of the cartridge into the tube, the possibility of optional admixing of air or the desired variability of cartridge length.

A disadvantage peculiar to these tobacco cartridges, however, is that they enclose only a homogeneous tobacco core and thus permit only limited variation of flavor impressions of the consumers. As far as filter cigarettes are concerned, this problem has been solved by the use of coaxial filter cigarettes, as is known from German Patents DE 3,901,226 C1 and 3,743,597 C1 as well as German Offenlegungsschrift Laid-open Application) DE 4,321,069 A1.

The coaxial filter cigarette according to German Patent DE 3,901,226 C1 is a cigarette with a strand portion comprising an inner core of a material that burns down largely without residue, especially tobacco material, a sheath for the inner core, an outer jacket consisting of a tobacco and/or non-tobacco material and coaxially surrounding the inner core or its sheath, and a sheath for the outer jacket. Furthermore, the cigarette is provided with a filter portion having a filter core, an air-impermeable sheath for the filter core, a filter jacket and a sheath for the filter jacket. The zone of the main heat source is located in the inner part of the strand portion, while the zone of production of the main part of the aerosol reaching the mouth of the smoker is located in the outer jacket of the strand portion. The filter portion largely reduces the combustion gases as well as smoke particles.

Going beyond this, the coaxial cigarette described in German Patent DE 3,743,597 C1 has a ventilated coaxial filter, which serves among other purposes for admixing of air.

Going beyond this, West German Application DE 4,321,069 A1 provides for the arrangement of a smoke-mixing zone between the tobacco strand and filter, for selective intermingling of the gases produced in the inner core and in the outer jacket of the strand portion. All three publications are based on the idea of greatly broadening the capabilities of varying the flavor impressions to be achieved through selection of the materials for the inner core and outer jacket of the strand portion. These variation capabilities are further improved to the effect that the inner-core sheath can be impregnated with substances that influence the aroma and/or the rate of burning. Heretofore, however, such a plurality of flavor impressions has not been available to consumers who make their own cigarettes.

It can be assumed, however, that the consumers who make their own tobacco products also have very diverse individual requirements of cigarette flavor, just as the smokers of factory-made cigarettes. In this area also, therefore, a need exists for greater capabilities of varying the flavor impression.

SUMMARY OF THE INVENTION

It is therefore the object of the present invention to provide a tobacco cartridge as well as use thereof by consumers who make their own cigarettes, which cartridge and use avoid the above disadvantages and in particular permit a greater range of variation of flavor impressions.

By the coaxial arrangement of two different tobacco blends in the inner core and outer jacket of the tobacco cartridge, it is possible to achieve effects that are not obtainable with a single tobacco blend. Thus the known advantages of coaxial filter cigarettes in regard to capabilities of varying the flavor impression are also made available to the group of consumers who roll/stuff their own.

In general the product developer has much more numerous and more special design or embellishment options than in the case of conventional known tobacco cartridges that consist of only one tobacco blend and the outer, highly air-permeable sheath. The following parameters among others are amenable to variation:

a) type, total weight and total volume of the first tobacco blend (in the inner core), b) type, total weight and total volume of the second tobacco blend (in the outer jacket), and c) type, total weight and total area of the sheath of the inner core as well as of the additives thereof.

Even more different alternatives can be created by combination with different filter tubes.

A further advantage in the use of a coaxially structured tobacco strand consists in the fact that the compressibility of the tobacco mass can be improved without decrease of quality below an acceptable limit value according to the "end loss" criterion. The compressibility of the tobacco mass is determined by the packing density. To increase the compressibility, the packing density in conventional tobacco cartridges must be lowered. This is possible only within limits, however, since the "end loss" becomes too great at too low packing density. If a tobacco cartridge according to the invention, with coaxially structured tobacco strand, is now used, a medium to high packing density can be achieved for the inner core, which is surrounded by a stabilizing sheath such as tobacco film. Thereby the packing density of the outer jacket of the coaxial tobacco strand can be much lower than the packing density of a conventional tobacco strand without allowing the "end loss" to exceed a critical limit value. A tobacco cartridge with such structure has better compressibility by virtue of the low packing density of the outer jacket, without being associated with the disadvantage of increased "end loss", since the tobacco cartridge is stabilized by the inner core with sheath. Thus low packing density of the tobacco cartridge is not achieved by grades with special fullness or by expanded tobacco, since these would be contrary to the objective of better compressibility.

The packing density of a conventional tobacco cartridge is about 230 mg/cm$^3$. In contrast, a packing density of 140 mg/cm$^3$ to 200 mg/cm$^3$ can be chosen for the outer jacket of the coaxially structured tobacco cartridge according to the invention. Preferably the range from which the packing density for the outer jacket is selected is that from 150 mg/cm$^3$ to 180 mg/cm$^3$. Particularly advantageous is a value of 160 mg/cm$^3$ for the packing density of the outer jacket. The inner core preferably has a packing density of between 220 mg/cm$^3$ and 300 mg/cm$^3$. Especially preferred is the range from 230 mg/cm$^3$ to 260 mg/cm$^3$. Advantageously the packing density of the inner core is 250 mg/cm$^3$.

In this connection the fullness of the tobacco being used must be 3.5 cm$^3$/g to 5.5 cm$^3$/g. The preferred range of fullness of the tobacco is 4.0 cm$^3$/g to 4.5 cm$^3$/g. Advantageously, the fullness of the tobacco is 4.2 cm$^3$/g.

Tobacco with lower fullness than for the inner core can also be selected for the outer jacket of the coaxially structured tobacco strand. Higher compressibility of the tobacco cartridge is also ensured in this way. Thus a further option for design or embellishment of the tobacco cartridge is available to the product developer, since further variations of flavor can be achieved by an outer jacket having a packing density that is not particularly low. In this connection the fullness of the outer jacket is preferably 3.5 cm$^3$/g to 4.2 cm$^3$/g, especially 3.8 cm$^3$/g. The fullness of the inner core is advantageously in the range of 4.5 cm$^3$/g to 5.5 cm$^3$/g, especially 5.0 cm$^3$/g.

The filter to be used for a coaxially structured tobacco cartridge can also be a coaxially structured filter element, which also has an inner core, a sheath for the inner core, an outer jacket and a sheath for the outer jacket. Thereby a further variation of flavor trend of the tobacco smoke can be achieved. Different advantageous versions exist for the disposition of the filter element on the tobacco cartridge. For example, a mixing space can be provided between the tobacco cartridge and the filter element, in which space the tobacco smoke from the inner core and the outer jacket can mingle before passing through the filter element to the consumer. Advantageously, the filter is structured as a multiple filter consisting of coaxial filter elements and standard filter elements such as cellulose acetate. One or more chambers can also be provided inside the multiple filter, preferably in the axial direction, so that capabilities of variation are created for the consumer by virtue of the differently structured filters.

The chambers can be empty or filled with granular material or activated charcoal.

The filter elements can be mounted directly on the tobacco cartridge. It is also possible, however, to integrate the filter elements in the tube.

By means of the filter elements described above, different flavor trends combined with the same condensate and nicotine values can be achieved in one and the same tobacco cartridge by using different coaxial filters. This is particularly true in the use of filter elements that treat the smoke from the inner core and the outer jacket in distinctly different ways. Thus the smoker can decide which filters he wishes to use for a given tobacco cartridge, in order to achieve the flavor trend that he prefers. Distinctly different flavor trends can therefore be achieved with the same tobacco cartridges by means of filter elements with such structure.

BRIEF DESCRIPTION OF THE DRAWINGS

The invention will be explained in more detail in the following by means of practical examples with reference to the attached schematic drawings wherein.

DESCRIPTION OF THE PREFERRED EMBODIMENTS

Figure 1:
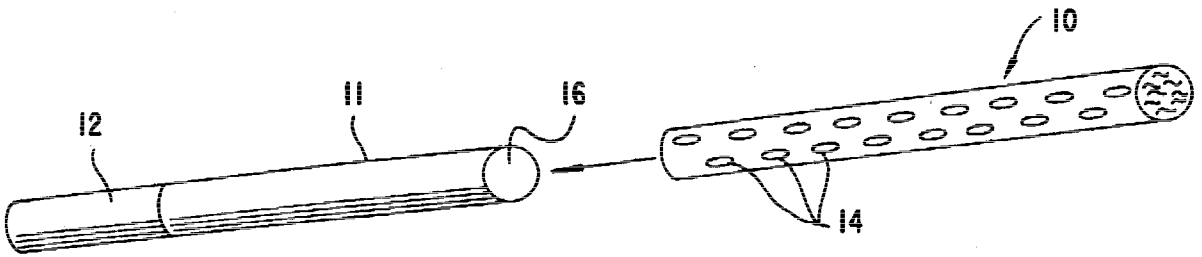
FIG. 1 shows a tobacco cartridge with corresponding cigarette-paper tube, consisting of sheath and filter.

The tobacco cartridge 10 according to the invention has a tobacco strand 21 with an inner core 27 of a first tobacco blend, a stabilizing sheath 28 of paper or especially of tobacco film for the inner core 27, an outer jacket 29 of a second tobacco blend and a sheath 23 of highly porous or highly perforated cigarette paper or tobacco film for the outer jacket 29. The perforations for the sheath 23 are indicated in FIG. 1 by the reference numbers 14. Alternatively, the sheath 23 can also be inherently porous, e.g., in the form of teabag paper.

Figure 2:
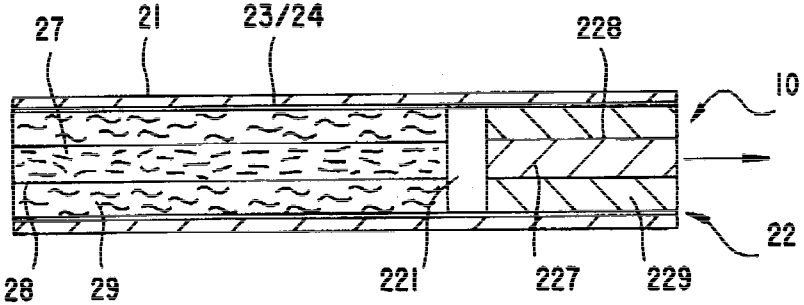
FIG. 2 shows a cross section through a tobacco cartridge according to the invention, which can be inserted into the tube in the direction of the arrow.

A filter 22 can be mounted on the tobacco strand 21 of the tobacco cartridge 10, which filter in the embodiment of FIG. 2 is structured as a coaxial filter, i.e., having an inner core 227, a sheath 228 for the inner core 227, an outer jacket 229 and a sheath for the outer jacket 229; in the example, the sheath 23 of the outer jacket of the tobacco strand 21 is used as the sheath for the outer jacket 229 of the filter 22, and so it performs a double function in this case.

The fullness of the tobacco blend is about 4.2 cm$^3$/g, while the packing density of the inner core 27 is about 250 mg/cm$^3$ and that of the outer jacket 29 is about 160 mg/cm$^3$.

A mixing space 221 (see FIG. 2) is formed between the tobacco strand 21 and the mounted filter 22 of the tobacco cartridge 10.

The tobacco strand 21 of the tobacco cartridge 10 certainly consists in its entirety of components that are consumable by smoking but, because of the high air permeability of the sheath 23, it can be smoked by the consumer only after introduction into the opening 16 of a cigarette-paper tube 11 (see FIG. 1) of matching length and diameter or after additionally being provided with a sheath of cigarette-paper strips of matching length and width.

The perforations 14 in the sheath 23 should be located at least in that zone of the tobacco cartridge 10 which surrounds the tobacco strand 21; it is also possible to provide such perforations 14 additionally in the sheath 23 of the filter portion 22, if correspondingly perforated or porous zones in the mouth-end zone of the tube 11 are supposed to act in concert with the perforations in the sheath of the filter portion 22.

As an alternative to the embodiment according to FIG. 2, the tobacco cartridge 10 may also contain only the tobacco strand 21, without a filter 22; if such a tobacco cartridge is to be used as a filter cigarette, a cigarette-paper tube 11 with an integrated filter 12 must be used, as indicated in FIG. 1.

Even this filter 12 of the cigarette-paper tube 10 can be structured as a coaxial, ventilated filter.

Figure 4:
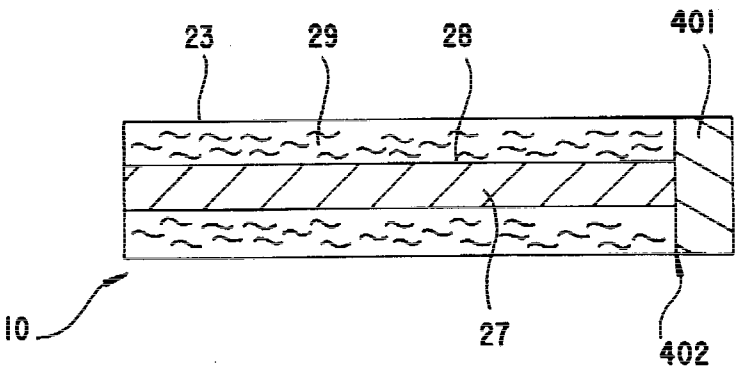
FIG. 4 shows a tobacco cartridge provided at one end with a smoke-impermeable barrier element.
Figure 3:
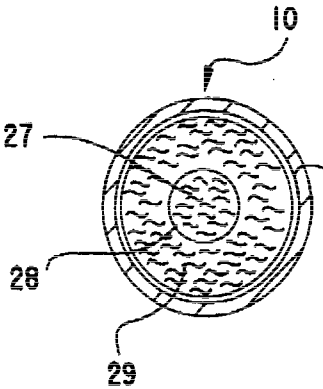
FIG. 3 shows a cross section through a tobacco cartridge according to the invention.

In the embodiment according to FIG. 4, at least one of the two end faces of the tobacco cartridge 10 is provided with at least one detachable, smoke-impermeable barrier element 401. This barrier element 401 is detachable through a perforation 402 in circumferential direction and serves, for example, as a safeguard to prevent smoking by children.

To diversify the flavor impressions, the sheath 28 of the inner core can be impregnated with substances that influence the aroma and/or burning rate. Such substances are used as standard additives in the cigarette industry and therefore will not be further explained.

Preferably the tobacco cartridge 10 is surrounded by an additional outer sheath 24 that has aroma-conserving and moisture-conserving qualities and that encloses the entire tobacco cartridge 10. This can be removed by the consumer before use. Expediently the sheath or packing 24 consists of plastic, cardboard or paper.

According to a further embodiment, the tobacco cartridge 10 has extra length relative to the tobacco-holding space of the cigarette-paper tube 11, so that tobacco-cartridge sections of accurately matching length are obtained only after the consumer has appropriately subdivided the tobacco cartridge 10. Preferably the length of the tobacco cartridge 10 in this case corresponds to an integral multiple of the length of the holding space of a cigarette-paper tube 11, and more preferably it corresponds to 2 or 3 times that length.

The mixing space 221 between the tobacco strand 21 and the filter 22 of the tobacco cartridge 10 in the embodiment according to FIG. 2 serves selectively to intermingle the streams of smoke arriving from the two tobacco-blend portions 27 and 29 and thus to create selective flavor impressions.

It is expedient for the air permeability of the sheath 28 of the inner core 27 of the tobacco strand to be lower than the air permeability of the sheath 23 of the outer jacket 29, whereby a further design parameter becomes available.

The separation of Burley and Virginia tobacco varieties represents one example of possible flavor variations by different tobacco blends in the inner core and in the outer jacket. Furthermore, aromatic substances such as menthol can be added to the outer jacket and the inner core.

As an alternative to the illustrated embodiments, it is also possible to use a standard cigarette-paper strip (not shown) instead of a pre-made cigarette-paper tube 11, the tobacco cartridge 10 then being wrapped inside this strip in the manner known for "roll-your-own cigarettes".

We claim:

1. A tobacco cartridge including a tobacco strand with at least one sheath of highly porous or highly perforated cigarette paper or tobacco film, so that the tobacco strand consists in its entirety of components that are consumable by smoking but, because of the high air permeability of the sheath, it can be smoked by the consumer only after introduction into a filter tube of matching length and diameter or after additionally being provided with a sheath of cigarette-paper strips of matching length and width, the tobacco strand being coaxially structured and comprising an inner core of a first tobacco blend having a packing density of approximately 220 mg/cm$^3$ to 300 mg/cm$^3$, a sheath of paper or tobacco film for the inner core, an outer jacket of a second tobacco blend having a packing density of 140 mg/cm$^3$ to 200 mg/cm$^3$ and the sheath of highly porous or highly perforated cigarette paper or tobacco film for the jacket, air permeability of the sheath of the inner core being lower than air permeability of the sheath of the outer jacket.

2. A tobacco cartridge according to claim 1, further including a coaxial, ventilated filter element mounted on the tobacco strand.

3. A tobacco cartridge according to claim 2, wherein an axial mixing space is provided between the tobacco strand and the filter element.

4. A tobacco cartridge according to claim 2, wherein the filter element is structured as a multiple filter containing at least one of coaxial filter plugs, filter plugs and chambers.

5. A tobacco cartridge according to claim 4, wherein the filter element includes at least one chamber filled with granular material or activated charcoal.

6. A tobacco cartridge according to claim 2, wherein the filter element is integral with a cigarette-paper tube.

7. A tobacco cartridge according to claim 2, wherein the filter element comprises an inner core and an outer jacket of materials of differing characteristics such that smoke from the inner core and outer jacket of the tobacco cartridge is treated in different ways in the inner core and the outer jacket of the filter element.

8. A tobacco cartridge according to claim 1, wherein at least one of the two end faces of the tobacco cartridge is provided with at least one detachable, smoke-impermeable barrier element.

9. A tobacco cartridge according to claim 8, wherein the at least one detachable, smoke-impermeable barrier element is detachable through a row of perforations in a circumferential direction.

10. A tobacco cartridge according to claim 1, wherein the sheath of the inner core is impregnated with a substance that influences at least one of aroma and burning rate of the sheath.

11. A tobacco cartridge according to claim 1, further including an external, aroma-conserving and moisture-conserving packing that encloses the entire tobacco cartridge and that can be removed by the consumer before use.

12. A tobacco cartridge according to claim 11, wherein the external, aroma-conserving and moisture-conserving packing is made of a materials selected from plastic, cardboard and paper.

13. A tobacco cartridge according to claim 1, wherein the tobacco cartridge has extra length relative to the tobacco-holding space of a cigarette-paper tube, so that sections of the tobacco cartridge of accurately matching length are obtained only after the consumer has appropriately subdivided the tobacco cartridge.

14. A tobacco cartridge according to claim 1, wherein fullness of the tobacco of both blends is approximately 3.5 cm$^3$/g to 5.5 cm$^3$/g.

15. A tobacco cartridge according to claim 14, wherein the fullness of the tobacco blend in the inner core is approximately 4.5 cm$^3$/g to 5.5 cm$^3$/g.

16. A tobacco cartridge according to claim 14, wherein the fullness of the tobacco in the outer jacket is 3.5 cm$^3$/g to 4.2 cm$^3$/g.

17. A tobacco cartridge according to claim 1, wherein fullness of the tobacco blend in the outer jacket is lower than the fullness of the tobacco blend in the inner core.

18. A tobacco cartridge according to claim 1, wherein the packing density of the inner core is approximately 230 mg/cm$^3$ to 260 mg/cm$^3$.

19. A tobacco cartridge according to claim 1, wherein the packing density of the outer jacket is 150 mg/cm$^3$ to 180 mg/cm$^3$.

20. A tobacco cartridge according to claim 1, wherein the fullness of the tobacco of both blends is approximately 4.0 cm$^3$/g to 4.5 cm$^3$/g.

* * * * *